US009927733B2

(12) United States Patent
Kishi et al.

(10) Patent No.: US 9,927,733 B2
(45) Date of Patent: Mar. 27, 2018

(54) IMAGE FORMING APPARATUS WITH REDUCED POSTTRANSFER LATENT IMAGE

(71) Applicant: CANON KABUSHIKI KAISHA, Tokyo (JP)

(72) Inventors: Yosuke Kishi, Suntou-gun (JP); Atsushi Toda, Fuji (JP); Naoki Fukushima, Minishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/291,921

(22) Filed: Oct. 12, 2016

(65) Prior Publication Data

US 2017/0108793 A1 Apr. 20, 2017

(30) Foreign Application Priority Data

Oct. 15, 2015 (JP) ..... 2015-204119

(51) Int. Cl.
*G03G 15/16* (2006.01)
*G03G 15/043* (2006.01)

(52) U.S. Cl.
CPC ..... *G03G 15/043* (2013.01); *G03G 15/1665* (2013.01)

(58) Field of Classification Search
CPC ..... G03G 15/043; G03G 15/1665
USPC ..... 399/51
See application file for complete search history.

(56) References Cited

U.S. PATENT DOCUMENTS

| | | | | |
|---|---|---|---|---|
| 5,583,616 | A | 12/1996 | Yamamoto et al. | 355/208 |
| 7,848,679 | B2 | 12/2010 | Kanai et al. | 399/128 |
| 2010/0239280 | A1* | 9/2010 | Inoue | G03G 21/08 399/44 |
| 2016/0179029 | A1 | 6/2016 | Shibuya | G03G 15/043 |

FOREIGN PATENT DOCUMENTS

| | | |
|---|---|---|
| JP | H08-87215 | 4/1996 |
| JP | 2008-191554 | 8/2008 |
| JP | 2009-008906 | 1/2009 |
| JP | 2009-175675 | 8/2009 |
| JP | 2013-130597 | 7/2013 |
| JP | 2015-060128 | 3/2015 |
| JP | 2016-057637 | 4/2016 |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes a rotatable photosensitive drum including a photosensitive layer; a drum charging member contacted or disposed closely to the drum, to be supplied with a DC voltage; a developing device; a transfer member for transferring a toner image onto a toner image receiving member; a device for applying to the transfer member a transfer bias voltage; a light projecting portion for projecting light to the drum before the charging and after the image transfer; a controller for controlling a quantity of the projected light, on the basis of the transfer bias and a film thickness of the photosensitive layer, wherein under a condition that the transfer bias is the same, the light amount controlled by the controller is smaller when the film thickness is a fourth value than when it is a third value, the fourth value being smaller than the third value.

8 Claims, 4 Drawing Sheets

IMAGE FORMING APPARATUS WITH REDUCED POSTTRANSFER LATENT IMAGE

FIELD OF THE INVENTION AND RELATED ART

The present invention relates to an image forming apparatus which uses an electrophotographic method.

Conventionally, in an image forming apparatus which uses an electrophotographic method, the peripheral surface of its photosensitive member (electrophotographic photosensitive member) is uniformly charged by its charging means. Then, the charged peripheral surface of the photosensitive member is exposed in accordance with the image data by an exposing means. Consequently, an electrostatic latent image is formed on the peripheral surface of the photosensitive drum. To the electrostatic latent image, toner is adhered. As a result, a toner image is formed on the peripheral surface of the photosensitive drum. Then, the toner image is transferred onto recording medium such as a sheet of paper. As the photosensitive member, a rotatable photosensitive drum, that is, a photosensitive member in the form of a drum, is widely in use.

In recent years, a contact charging method has become the mainstream means for charging a photosensitive member. There are various contact charging methods. However, in most cases, a charge roller, which is an electrically conductive roller, is used as a charging member (contact charging member). That is, a roller type charging method, which charges a photosensitive member by applying voltage to a charge roller which is disposed in contact with the photosensitive member, is widely in use. By the way, in a contact charging method, the peripheral surface of a photosensitive drum is charged by the electrical discharge which occurs through a minute gap between the charging member and photosensitive drum. Therefore, even if a noncontact charging member, which is placed virtually in contact with a photosensitive member, is used in place of a contact charge roller (noncontact charging method), it is possible to charge the photosensitive member as described above. Here, the present invention is described with reference to a contact charging method (roller charging method) as a charging method which represents both the contact charging method and a noncontact charging method.

There are two types of contact charging method. One is a DC-based charging method which applies only DC voltage to a charge roller. The other is an AC-based method which applies a combination of AC voltage and DC voltage, to a charge roller. An AC-based method is advantageous in that it can make the peripheral surface of a photosensitive drum more uniform in potential than a DC-based method. On the other hand, an AC-based method is greater in the amount of energy required for the electrical discharge to occur through the aforementioned minute gap than a DC-based method. Therefore, it is more likely to damage the peripheral surface of a photosensitive drum, being therefore greater in the amount by which the peripheral surface of a photosensitive member is worn than a DC-based method. Thus, the life span of a photosensitive member is shorter when it is used with an AC-based method than when it is used with a DC-based method. In comparison, a DC-based method is smaller in the amount of energy required for the electrical discharge to occur through the aforementioned minute gap than an AC-based method, being therefore smaller in the amount of damage it causes to a photosensitive drum. Therefore, a photosensitive member lasts longer when it is used with a DC-based method than when it is used with an AC-based method. Thus, from the standpoint of the durability of a photosensitive member, a DC-based method is preferable.

However, a DC-based method is likely to suffer from the following problem. That is, in a transfer process, the peripheral surface of the photosensitive member is subjected to the electrical discharge caused by transfer bias. Sometimes, therefore, the peripheral surface of the photosensitive member is nonuniform in potential level immediately after the completion of the transfer process. This phenomenon is attributable to the remnant of the latent image formed on the peripheral surface of the photosensitive drum to form a toner image, prior to the image transfer. Hereafter, this phenomenon that the peripheral surface of the photosensitive drum is nonuniform in potential level may be referred to as post-transfer latent image (post-transfer ghost). If the photosensitive member is charged while it is suffering from this post-transfer latent image, it is possible that abnormal electrical discharge will occur between the charge roller and photosensitive member, in the pattern of the post-transfer latent image on the peripheral surface of the photosensitive member. Thus, it is possible that the image forming apparatus will output such defective images that are nonuniform in density.

Thus, various technologies have been developed to rid the peripheral surface of a photosensitive member, of the nonuniformity in potential level, which is attributable to the post-transfer latent image, which is present on the peripheral surface of the photosensitive drum after the transfer process. For example, it is disclosed in Japanese Laid-open Patent Application No. H08-87215 to illuminate the peripheral surface of a photosensitive member with light (discharging light) with the use of a pre-exposing means having such a light source as an LED, in order to rid the peripheral surface of the photosensitive member of the post-transfer latent image.

However, if the peripheral surface of a photosensitive member is continuously illuminated with excessively strong discharging light for a substantial length of time, the photosensitive member is deteriorated at an accelerated rate. For example, the peripheral surface of the photosensitive member is shaved at an accelerated rate. Thus, the amount by which discharging light is shed on the peripheral surface of the photosensitive member is desired to be as small as possible within a range in which the post-transfer latent image on the peripheral surface of the photosensitive member, can be completely removed. By doing so, it is possible to accomplish both the object of preventing an image forming apparatus from outputting defective images, the defects of which are attributable to the post-transfer latent image which is present on the peripheral surface of the photosensitive drum after the transfer process, and the object of extending the life span of the photosensitive member.

SUMMARY OF THE INVENTION

Thus, the primary object of the present invention is to provide an image forming apparatus which is capable of minimizing, after the transfer process, its photosensitive member in the amount of the post-transfer latent image, which is present on the peripheral surface of the photosensitive drum 1 after the transfer process, while substantially increasing the photosensitive drum in its life span compared to the photosensitive member in any conventional image forming apparatus.

According to an aspect of the present invention, there is provided an image forming apparatus comprising a rotatable photosensitive member including a photosensitive layer; a charging member provided in contact with or in proximity with said photosensitive member and configured to be supplied with a DC voltage to charge a surface of said photosensitive member; developing means configured to develop an electrostatic image formed on said photosensitive member into a toner image, after charging of said photosensitive member by said charging means; a transfer member configured to transfer the toner image from said photosensitive member onto a toner image receiving member; an application device configured to apply to said transfer member a transfer bias voltage for transferring the image from said photosensitive member onto the toner image receiving member; a light projecting portion configured to project light to said photosensitive member before the charging by said charging means and after the image transfer by said transfer means; and a controller configured to control a light quantity of the light projected to said photosensitive member by said light projecting portion, on the basis of information relating to the transfer bias and information relating to a film thickness of said photosensitive layer, wherein under a condition that the transfer bias is the same, the light amount controlled by said controller is smaller when the film thickness is a fourth value than when it is a third value, the fourth value being smaller than the third value.

Further features of the present invention will become apparent from the following description of exemplary embodiments with reference to the attached drawings.

DESCRIPTION OF THE EMBODIMENTS

Hereinafter, the image forming apparatus in the first embodiment of the present invention is described in detail with reference to appended drawings.

Embodiment 1

1. Overall Structure and Operation of Image Forming Apparatus

Figure 1:
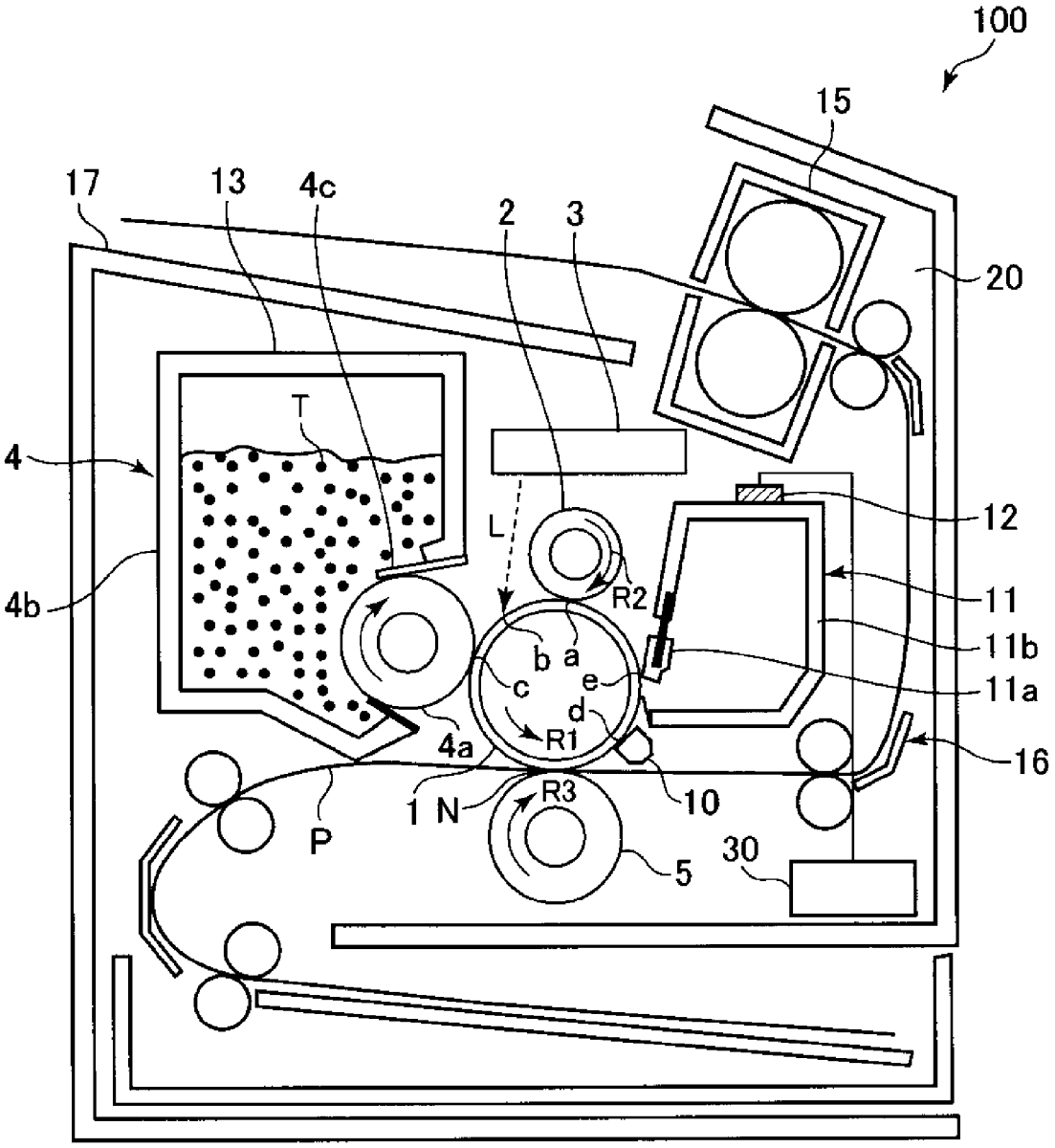
FIG. 1 is a schematic sectional view of a typical image forming apparatus to which the present invention is applicable.

FIG. 1 is a schematic sectional view of the image forming apparatus 100 in the first embodiment of the present invention. The image forming apparatus 100 in this embodiment is a laser beam printer which uses an electrophotographic method.

Figure 2:
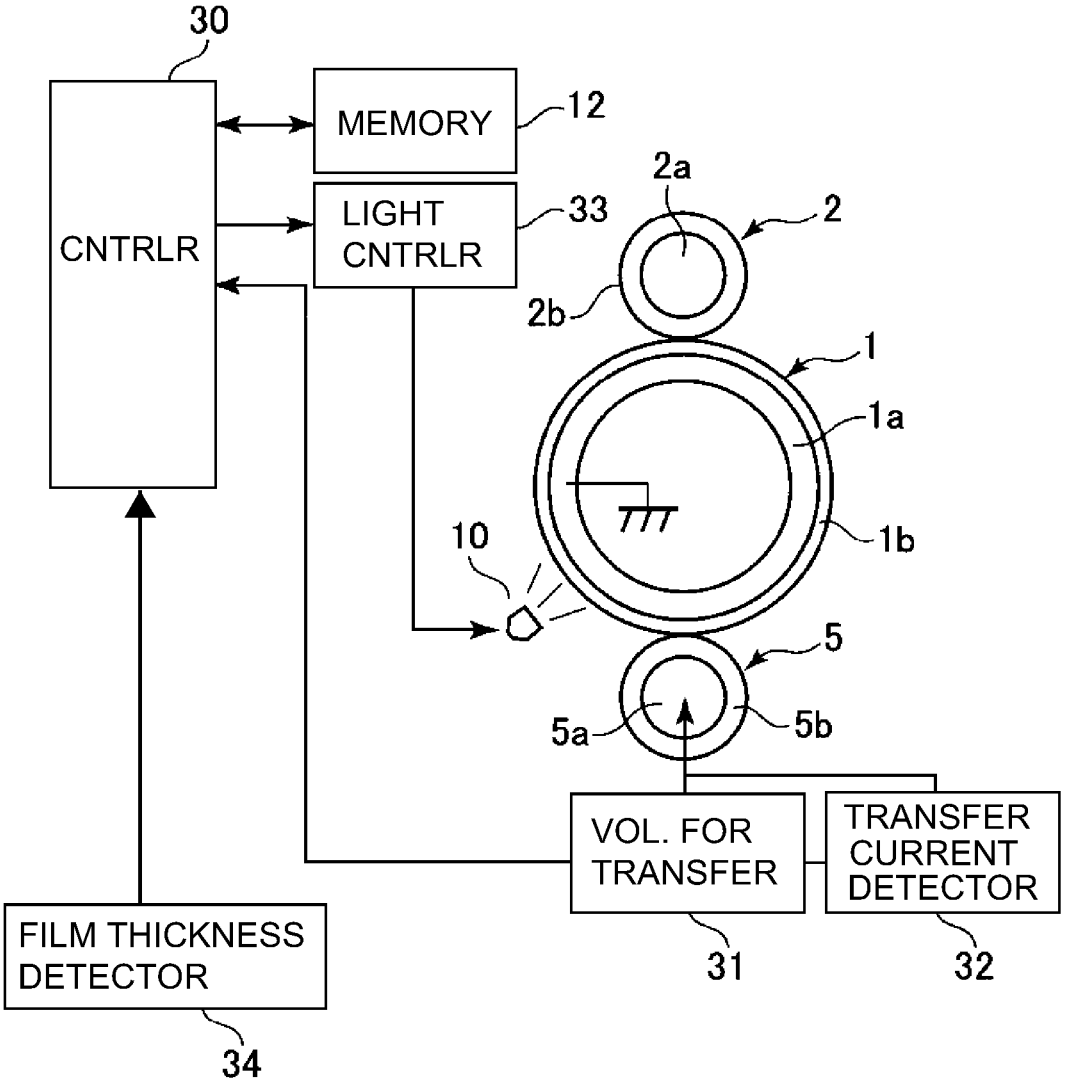
FIG. 2 is a block diagram of the image forming apparatus, shown in FIG. 1, which shows the control sequence for controlling the essential portions of the image forming apparatus.

The image forming apparatus 100 has a photosensitive drum 1 (electrophotographic photosensitive member), as an image bearing member, which is rotatable. The photosensitive drum 1 is made up of an electrically conductive drum 1*a* (as substrate: FIG. 2) which is formed of aluminum or the like; and a layer 1*b* (photosensitive layer) formed, as a surface layer, on the peripheral surface of the drum 1*a*, of an organic or inorganic photoconductive substance. In particular, in this embodiment, the photosensitive drum 1 is provided with an organic photosensitive layer (OPC layer). The drum substrate 1*a* is electrically grounded. The photosensitive drum 1 is rotationally driven by a driving motor (unshown) as a driving force source, at a preset peripheral velocity (process speed) in the direction indicated by an arrow mark R1 in the drawing.

As the photosensitive drum 1 is rotationally driven, its peripheral surface is uniformly charged to preset polarity (negative in this embodiment) and potential level by a charge roller 2, which is charging member (contact charging member) as a charging means. The charge roller 2 is an electrically conductive roller. It is made up of an electrically conductive metallic core 2*a* (FIG. 2), and an electrically conductive elastic layer 2*b* (FIG. 2) formed of electrically conductive rubber or the like, on the peripheral surface of the metallic core 2*a*, in a manner to fit around the metallic core 2*a*. The charge roller 2 is disposed in contact with the photosensitive drum 1. The rotational axis of the charge roller 2 is roughly in parallel to the rotational axis of the photosensitive drum 1. The charge roller 2 is kept pressed toward the photosensitive drum 1. It is rotated by the rotation of the photosensitive drum 1. In the charging process, DC voltage which is preset in polarity (negative in this embodiment) is applied as charge bias (charge voltage) to the metallic core 2*a* of the charge roller 2 by an unshown charge voltage power source (high voltage electrical power circuit), as a charge voltage application device. That is, in this embodiment, the contact charging method and a DC current-based method are employed. In this embodiment, the charge bias is controlled so that the potential level (charge level) of the peripheral surface of the photosensitive drum 1 is −500 V after the charging of the photosensitive drum 1. The charge roller 2 charges the photosensitive drum 1 with the use of the electric discharge which occurs through a minute gap formed between the charge roller 2 and photosensitive drum 1, on the upstream and downstream of the photosensitive drum 1 in terms of the rotational direction of the photosensitive drum 1. Also in terms of the rotational direction of the photosensitive drum 1, the area (where photosensitive drum 1 and charge roller 2 oppose each other) in which the peripheral surface of the photosensitive drum 1 is charged by the charge roller 2 is a charging portion a (charging position).

The charged peripheral surface of the photosensitive drum 1 is scanned by (exposed to) a beam of light outputted by an exposing device 3 (laser scanner unit) as an exposing means. Consequently, an electrostatic latent image (electrostatic image), which is in accordance with image data, is effected on the peripheral surface of the photosensitive drum 1. The exposing device 3 has a laser, a polygon mirror, a lens system, etc. In terms of the rotational direction of the photosensitive drum 1, a position in which the peripheral surface of the photosensitive drum 1 is illuminated by the beam of light from the exposing device 3 is an exposing portion b (exposure position).

After an electrostatic latent image is formed on the peripheral surface of the photosensitive drum 1, the electrostatic latent image is developed into a visible image with the use of a combination of a developing device 4 as a developing means and toner T. As a result, a toner image (developer image) which reflects the image data is formed on the peripheral surface of the photosensitive drum 1. In this embodiment, a toner image is formed by a combination of the exposure by the exposing device and the reversal development by the developing device. That is, as the peripheral surface of the photosensitive drum 1 is uniformly charged, it is exposed by the exposing device. As the peripheral surface of the photosensitive drum 1 is exposed, various points of the peripheral surface of the photosensitive drum 1 reduce in potential in terms of absolute value. Then, toner charged to the same polarity (negative in this embodiment) as the photosensitive drum 1 is adhered to the exposed points of the peripheral surface of the photosensitive drum 1, which were reduced in potential level in terms of absolute value by being exposed after the peripheral surface of the photosensitive drum 1 was charged. The developing device 4 has: a development roller 4*a*, as a developer bearing member (developing member) which bears toner and conveys the toner to an area where the development roller 4*a* opposes the photosensitive drum 1; a container 4*b* which stores the toner T; and a coating member 4*c* which coats the development roller 4*a* with the toner T. The development roller 4*a* is rotationally driven in the direction indicated by an arrow mark R2 in the drawing. In the development process, a preset development bias (development voltage) is applied to the development roller 4*a* by an unshown development voltage power source (high voltage power circuit) as a developer bias applying device, to the development roller 4*a*. Also in terms of the rotational direction of the photosensitive drum 1, a position (where photosensitive drum 1 and development roller 4*a* oppose each other) in which toner T is supplied to the photosensitive drum 1 from the development roller 4*a* is a developing portion c (development position).

The toner image formed on the peripheral surface of the photosensitive drum 1 is transferred onto a sheet of recording medium (transfer medium) such as paper, plastic, etc., by a transfer roller 5, as a transferring means, which is a transferring member in the form of a roller. The transfer roller 5 is an electrically conductive roller, which is made up of an electrically conductive metallic core 5*a* (FIG. 2), and an electrically conductive elastic layer 5*b* (FIG. 2) formed on the peripheral surface of the conductive metallic core 5*a*, of electrically conductive rubber or the like, in the shape of a roller which fits around the metallic core 5*a*. In this embodiment, a sponge roller formed of foamed electrically conductive substance is used as the electrically conductive layer 5*b* of the transfer roller 5. The transfer roller 5 is disposed in contact with the photosensitive drum 1. The rotational axis of the transfer roller 5 is roughly parallel to the rotational axis of the photosensitive drum 1. The transfer roller 5 is rotationally driven in the direction indicated by an arrow mark R3 in the drawing (so that peripheral surface of photosensitive drum 1 and peripheral surface of transfer roller 5 move in the same direction in the area of contact between photosensitive drum 1 and transfer roller 5). In the transfer process, DC voltage which is opposite in polarity (positive in this embodiment) from toner charge is applied, as development bias (transfer voltage), to the metallic core 4*a* of the transfer roller 5, by a transfer voltage power source 31 (high voltage power source circuit) (FIG. 2). Consequently, the toner image on the photosensitive drum 1 is electrostatically transferred onto a sheet P of recording medium by the function of the electric field formed in a transferring portion N. The transfer roller 5 is kept pressed toward the photosensitive drum 1. In terms of the rotational direction of the photosensitive drum 1, the position in which the contact between the photosensitive drum 1 and transfer roller 5 forms a nip is the transferring portion N (transferring position).

After the transfer of a toner image onto a sheet P of recording medium, the sheet P is separated from the peripheral surface of the photosensitive drum 1, and is introduced into a fixing device 12, as a fixing means, by a conveying device 16. The fixing device 12 fixes the toner image to the sheet P by heating and pressing the sheet P on which the unfixed toner is present. As the sheet P comes out of the fixing device 12, it is discharged into a delivery tray 17 which is outside the main assembly 20 of the image forming apparatus 100.

Meanwhile, after the separation of a sheet P of recording medium from the peripheral surface of the photosensitive drum 1, the peripheral surface of the photosensitive drum 1 is entirely exposed (illuminated) by a pre-exposing device 10 (discharging device) as a pre-exposing means (illuminating portion). Before the photosensitive drum 1 is charged by the charge roller 2, the pre-exposing device 10 exposes the entirety of the peripheral surface of the photosensitive drum 1 to remove at least a part of the surface potential of the photosensitive drum 1, in order to make uniform in potential level at least a part of the peripheral surface of the photosensitive drum 1 which is nonuniform in potential after the secondary transfer. In other words, the pre-exposing device 10 is an erasing means which sheds light upon the peripheral surface of the photosensitive drum 1 to remove at least parts of the residual electrical charge on the peripheral surface of the photosensitive drum 1. As the light source for the pre-exposing device 10, an LED, a halogen lamp, or the like can be used. There is no restriction regarding the usable light source. However, from the standpoint of making the pre-exposing device 10 as small as possible in driving voltage, and making it easier to reduce the pre-exposing device 10 in size, it is desired to use an LED as the light source. In this embodiment, LEDs were used. By the way, all that is required of the pre-exposing device 10 is that it can shed light on the image formation area (across which toner image can be formed) in terms of the direction parallel to the rotational axis of the photosensitive drum 1. In terms of the rotational direction of the photosensitive drum 1, the point in which light is shed by the pre-exposing device 10 is a pre-exposing portion d (pre-exposure position).

Further, after the shedding of light upon the peripheral surface of the photosensitive drum 1 by the pre-exposing device 10, the peripheral surface of the photosensitive drum 1 is cleaned by a cleaning device 11; residual adherents such as transfer residual toner and paper dusts are removed from the peripheral surface of the photosensitive drum 1. The cleaning device 11 has a cleaning blade 11*a* (elastic blade) as a cleaning member; and a container 11*b*. The cleaning blade 11*a* is disposed in contact with the peripheral surface of the photosensitive drum 1 in such an attitude that its cleaning edge is on the upstream side of its base portion in terms of the rotational direction of the photosensitive drum 1. As the photosensitive drum 1 is rotated, the residual adherents on the peripheral surface of the photosensitive drum 1 are scraped down by the cleaning blade 11*a*, and are stored in the container 11*b*. In terms of the rotational direction of the photosensitive drum 1, the area of contact between the photosensitive drum 1 and cleaning blade 11*a* is the cleaning portion e (cleaning position).

By the way, in this embodiment, the pre-exposing device 10 is disposed so that in terms of the rotational direction of the photosensitive drum 1, it sheds light on the peripheral surface of the photosensitive drum 1, on the downstream side of the transferring portion N, and on the upstream side of the cleaning portion e. However, the pre-exposing device 10 may be disposed so that it sheds light upon the peripheral surface of the photosensitive drum 1 on the downstream side of the transferring portion N, and on the upstream side of the charging portion a, in terms of the rotational direction of the photosensitive drum 1.

Certain portions of the image forming portion may be placed in a cartridge which is removably mountable in the main assembly 20 of the image forming apparatus 100. In this embodiment, the photosensitive drum 1, and photosensitive drum processing means, that is, the charge roller 2, developing device 4, and cleaning device 11, are integrally placed in a cartridge to make up a process cartridge 13. If the amount of the toner in the developing apparatus 4 becomes no more than a preset value, for example, the process cartridge 13 in the main assembly 20 of the image forming apparatus 100 is taken out of the main assembly 20, and is replaced with a brand-new one. The process cartridge 13 is provided with a storage portion 12 (memory portion) as a storing means for storing the information related to the process cartridge 13. The storing portion 13 (memory portion) has an electrical storing means (memory), and a communicating portion. Further, the main assembly 20 is provided with a communicating portion (unshown). Thus, as the process cartridge 13 is installed into the main assembly 20, it is possible for information to be sent and received between the controller 30 with which the main assembly 20 is provided, and the storing portion 12, by way of the abovementioned communicating portion of the process cartridge 13 and the communicating portion of the main assembly 20.

As the image forming apparatus 100 receives an image formation start command, it begins to carry out an image forming operation (sequence: job, printing operation) for forming an image on a single sheet P, or multiple images on multiple sheets P of recording medium, one for one, and outputting the image or images. Generally speaking, a job has an image formation process, a pre-rotation process, sheet intervals which occur between two consecutively conveyed sheets P of recording medium in a continuous image forming operation, and a post-rotation process. The image formation process corresponds to a period in which an electrostatic image of an image to be formed on a sheet P of recording medium to be outputted is formed; a toner image is formed; and a toner image is transferred. That is, an "image formation period" refers to this period. To describe in greater detail, the position in which an electrostatic latent image is formed, position in which a toner image is formed, and position in which a toner image is transferred are different in the timing with which the image formation process is carried out. The pre-rotation process corresponds to a period from a point in time at which an image formation start command is inputted, to a point in time at which an image begins to be actually formed. That is, it corresponds to a period for preparing the image forming apparatus 100 for image formation. The sheet interval corresponds to a period which occurs between two sheets P of recording medium which are consecutively conveyed in an image forming operation for continuously forming multiple images on multiple sheets P of recording medium, one for one. The post-rotation process corresponds to a period in which the image forming apparatus 100 is processed for the termination of the image forming operation (prepared for next image forming operation) immediately after the completion of the image formation process. "Idling periods" correspond to other periods than the image formation periods. They include the abovementioned pre-rotation period, sheet interval periods, and post-rotation period. Further, they include the pre-rotation process which corresponds to the preparatory operation to be carried out when the image forming apparatus 100 is turned on, or it is reactivated while being kept in the "sleep mode".

2. Transfer Bias Control

In this embodiment, the transfer bias is controlled as follows. That is, the transfer bias control sequence is carried out when no sheet P of recording medium is in the transferring portion N. It is carried out to ensure that the amount by which electric current is made to flow through the transfer roller 5 (transfer voltage power source 31) by the transfer bias remains stable at a target value. Then, the voltage value for the transfer bias to be applied to the transfer roller 5 in the transfer process is set according to the transfer bias value (voltage value), which made electric current to flow through the charge roller by a target amount (target current value). In this embodiment, the voltage value of the transfer bias required to cause electric current to flow by the target amount is used as the voltage value for the transfer bias for the transfer process. However, a value obtained by multiplying the thus obtained voltage value may be used as the voltage value for the transfer bias for the transfer process, which is different from the value which corresponds to the target current value for the transfer process.

FIG. 2 is a block diagram of the control sequence for controlling the essential portions of the image forming apparatus 100 in this embodiment. In this embodiment, the main assembly 20 (which hereafter may be referred to as apparatus main assembly) of the image forming apparatus 100 is provided with the controller 30, as a controlling portion, which integrally controls the operation of each of various portions of the image forming apparatus 100. The controller 30 is provided with a computation controlling portion (CPU), storing portions (ROM, RAM), etc. It is the computation controlling portion that carries out control sequences based on the programs and data stored in the storing portions.

Transfer power source 31 applies DC voltage, which is preset in polarity (positive in this embodiment), to the transfer roller 5 while remaining under the control of the controller 30. The transfer power source 31 is in connection to a transfer current detecting portion 32 (current detection circuit) as an electric current detecting means for detecting the electric current which flows through the transfer roller 5 (transfer power source 31) as the transfer bias is applied to the transfer roller 5 from the transfer power source 31. The transfer current detecting portion 32 detects the abovementioned current while remaining under the control of the controller 30, and inputs the results of the detection into the transfer power source 31. Further, the apparatus main assembly 20 is provided with a temperature/humidity sensor (unshown), as an ambience detecting means, which detects the ambient temperature and humidity of the image forming apparatus 100. Further, the storing portion of the controller 30 holds the information regarding the relationship between the ambient temperature and humidity, and the abovementioned target current values.

The controller 30 chooses the target current value, which corresponds to the ambient temperature and humidity detected by the temperature/humidity sensor. The transfer power source 31 controls its output, based on the current value detected by the transfer current detecting portion 32, in order to keep the amount by which current flows through the transfer roller 5 remaining at the target value given by the controller 30. Then, the controller 30 chooses the output value of the transfer power source 31 as the voltage value for the transfer bias for the transfer process. In this embodiment, the controller 30 carries out the above-described transfer bias control sequence for every job, in the pre-rotation process. Then, it makes the transfer power source 31 apply to the transfer roller 5, the transfer bias, the value of which was set in the pre-rotation process for the current job.

Therefore, it is possible to apply to the transfer roller 5, transfer bias having a proper value, that is, such a value that can provide the transfer roller 5 with a proper amount of current, according to the ambient temperature and humidity, electrical resistance value of the transfer roller 5, thickness of the photosensitive layer of the photosensitive drum 1, and the like factors, in the transfer process. That is, the transfer bias applied to the transfer roller 5 in the transfer process is affected by the ambient temperature and humidity, electrical resistance value of the transfer roller 5, thickness of the photosensitive layer of the photosensitive drum 1, and the like factors. By the way, the information regarding the ambience of the image forming apparatus 100 may be at least one of the temperature and humidity. Further, the ambiance detecting means may be such that it detects at least one of the internal or external ambience of the apparatus main assembly 20.

3. Control Sequence for Controlling Pre-Exposure Light Amount

In this embodiment, the pre-exposing device 10 sheds light on the peripheral surface of the photosensitive drum 1 to prevent the occurrence of image defects such as nonuniformity in density, which are attributable to the post-transfer latent image, that is, the nonuniformity, in potential level, of the peripheral surface of the photosensitive drum 1, which is present immediately after the completion of the transfer process. In order to prevent the occurrence of these image defects, it is necessary to shed light (erasing light) on the peripheral surface of the photosensitive drum 1 by an amount (necessary to render peripheral surface of photosensitive drum 1 uniform in potential level) which is no less than the minimum amount which is necessary to rid the peripheral surface of the photosensitive drum 1, of the post-transfer latent image.

Here, it is reasonable to think that as long as the light for erasing the residual latent image is shed on the peripheral surface of the photosensitive drum 1 by an amount which is substantially greater than the abovementioned minimum amount necessary, with the use of the pre-exposing device 10, there occurs no issue regarding the image defects attributable to the post-transfer latent image. However, if the discharging light is continuously shed on the peripheral surface of the photosensitive drum 1 by an amount which is significantly greater than the minimum amount necessary, the peripheral surface of the photosensitive drum 1 is increased in the rate at which it is deteriorated by the discharging light. Consequently, the photosensitive drum 1 is reduced life expectancy.

On the other hand, it became evident, from the studies made by the inventors of the present invention, that the post-transfer latent image, which is likely to be present immediately after the completion of the transfer process, and which is likely to become an issue when the DC-based charging method is employed as the means for charging the photosensitive drum 1, is affected by a combination of the transfer bias, and the thickness of the photosensitive layer of the photosensitive drum 1.

In this embodiment, therefore, the amount (which may be referred to as pre-exposure light amount) by which light is shed on the photosensitive drum 1 by the pre-exposing device 10 is controlled according to a combination of the transfer bias and the thickness of the photosensitive layer of the photosensitive drum 1. With the use of this control, it is possible to achieve both the objective of preventing the occurrence of the image defects attributable to the post-transfer latent image, which is present immediately after the completion of the transfer process, and the objective of increasing the photosensitive drum 1 in life expectancy.

As described above, in this embodiment, the pre-exposing device 10 has an LED (unshown) as light source. The amount by which light is shed by the pre-exposing device 10 can be varied by changing the amount by which light is emitted by the LED. In this embodiment, the pre-exposing device 10 is provided with an LED, which is disposed adjacent to one of the lengthwise ends of the photosensitive drum 1 in terms of the direction parallel to the rotational axis of the photosensitive drum 1, and a light guide (unshown) as a light guiding means for guiding the light emitted by the LED. The light guide is disposed so that it extends roughly in parallel to the rotational axis of the photosensitive drum 1. It is provided with multiple reflecting portions which are in alignment in the direction parallel to the rotational axis of the photosensitive drum 1, and which deflect the light from the LED toward the photosensitive drum 1. Thus, the pre-exposing device 10 can shed light across roughly entirety of the photosensitive drum 1 in terms of the direction parallel to the rotational axis of the photosensitive drum 1. However, this embodiment is not intended to limit the present invention in terms of the structure of the pre-exposing device 10. For example, the present invention is also applicable to an image forming apparatus, the pre-exposing device 10 of which has multiple light sources aligned in the direction parallel to the axial line of the photosensitive drum 1. By the way, in this embodiment, it is assumed that in the image formation process, the photosensitive drum 1 is practically stable in peripheral velocity, and the amount by which light is shed by the pre-exposing device 10 is expressed in the amount by which light is shed on the peripheral surface of the photosensitive drum 1 per unit area.

Referring to FIG. 2, the image forming apparatus 100 has a light amount controlling portion 33 (driving circuit), which is in connection to the pre-exposing device 10 and can change the amount by which light is shed by the pre-exposing device 10. The light amount controlling portion 33 changes the amount by which light is shed by the pre-exposing device 10, while remaining under the control of the controller 30. In this embodiment, the light amount controlling portion 33 controls the pre-exposure light amount by changing the voltage (current) which is inputted into the LED of the pre-exposing device 10.

Further, referring to FIG. 2, the image forming apparatus 100 has a thickness detecting portion 34 for obtaining the information related to the thickness of the photosensitive layer of the photosensitive drum 1, while remaining under the control from the controller 30. In this embodiment, the thickness detecting portion 34 measures the length of time the photosensitive drum 1 is rotated, which is an example of information (usage history) related to the amount of usage of the photosensitive drum 1, as the information related to the thickness of the photosensitive layer of the photosensitive drum 1, for each cartridge 13. By the way, the number of times the photosensitive drum 1 has been rotated may be used in place of the length of time the photosensitive drum 1 has been rotated. Here, the embodiment is described assuming that the length of time the photosensitive drum 1 has been rotated is measured. The controller 30 cumulatively stores the length of time the photosensitive drum 1 is rotated, which is measured by the thickness detecting portion 13 (counter), in the storing portion 12 of the process cartridge 13. That is, the surface layer of the photosensitive drum 1 is shaved by an image forming operation. Thus, as the length of time the photosensitive drum 1 is rotated is increased by the repetition of the image forming operation, the surface layer of the photosensitive drum 1 is gradually shaved, becoming therefore thinner. There is a correlation between the thickness of the photosensitive layer of the photosensitive drum 1 and the length of time the photosensitive drum 1 was rotated. Therefore, by obtaining in advance this correlation, the cumulative length of time the photosensitive drum 1 was rotated can be used in place of the thickness of the photosensitive layer of the photosensitive drum 1. As described above, in this embodiment, the information regarding the length of time the photosensitive drum 1 was rotated, which was obtained by the thickness detecting portion 34 is inputted into the storing portion 12, while being continuously renewed. By the way, various information other than the cumulative length of time the photosensitive drum 1 was rotated may be exchanged between the controller 30 and storing portion 12. For example, such values that indicate the characteristics of the process cartridge 13 may be exchanged between the controller 30 and storing portion 12.

The controller 30 obtains the value for the output (pre-exposure light amount) for the pre-exposing device 10, based on the value set for the transfer bias as described above, and the cumulative length of time the photosensitive drum 1 was rotated, which is in the storing portion 12 of the controller 30. In this embodiment, the controller 30 selects the pre-exposure light amount, based on the information, such as those given in Table 1, which shows the relationship between the value for the transfer bias (voltage), and the thickness of the photosensitive layer of the photosensitive drum 1 (cumulative length of time photosensitive drum 1 has been rotated), and sets it as the pre-exposure light amount for the pre-exposure process. In this embodiment, the controller 30 carries out a control sequence such as the above-described one for setting the pre-exposure light amount (value for transfer bias (voltage) in the pre-rotation process, for each job (value to be used for deciding pre-exposure light amount is value decided in the same job). Then, in the pre-exposure process in the job, the controller 30 uses the pre-exposure light amount decided in the pre-rotation process in the job, as the amount by which it makes the pre-exposing device 10 shed discharging light upon the peripheral surface of the photosensitive drum 1. Table 1 which is created in advance shows the relationship between the thickness of the photosensitive layer of the photosensitive drum 1 and the transfer voltage. It shows the minimum amount for the transfer voltage, which is necessary to completely rid the peripheral surface of the photosensitive drum 1, of the post-transfer latent image, when the transfer voltage is in a specific range, and the thickness of the photosensitive layer of the photosensitive drum 1 is in a specific range (to make peripheral surface of photosensitive drum 1 uniform in potential level).

TABLE 1

| | | Transfer voltage (kV) | | | | | |
|---|---|---|---|---|---|---|---|
| | | 3.0- | 2.5-3.0 | 2.0-2.5 | 1.5-2..0 | 1.0-1.5 | -0.5 |
| Film thickness of | 20- | 3.3 | 3.3 | 3.3 | 3.3 | 3.3 | 3.0 |
| | 18-20 | 3.0 | 3.0 | 3.0 | 3.0 | 3.0 | 2.7 |

TABLE 1-continued

| | | Transfer voltage (kV) | | | | | |
|---|---|---|---|---|---|---|---|
| | | 3.0- | 2.5-3.0 | 2.0-2.5 | 1.5-2..0 | 1.0-1.5 | -0.5 |
| Photosensitive drum (μm) | 16-18 | 3.0 | 2.7 | 2.7 | 2.7 | 2.7 | 2.5 |
| | 14-16 | 2.7 | 2.5 | 2.5 | 2.5 | 2.5 | 0 |
| | -14 | 2.5 | 2.5 | 2.5 | 0 | 0 | 0 |

According to the studies made by the inventors of the present invention, the smaller the difference in potential level between the transfer bias and the electrical charge of the peripheral surface of the photosensitive drum 1, the less likely it is for the post-transfer latent image to occur after the completion of the transfer process, for the following reason. That is, it seems to be reasonable to think that the smaller the difference in potential level between the transfer bias and the electrical charge of the peripheral surface of the photosensitive drum 1, the less likely it is for the electrical discharge attributable to the transfer bias, which is the cause of the occurrence of the post-transfer latent image, that is, the nonuniformity in potential level, on the peripheral surface of the photosensitive drum 1. That is, the smaller the difference in potential level between the transfer bias and the electrical charge of the photosensitive drum 1, the smaller the pre-exposure light amount may be. In this embodiment, it is assumed that the photosensitive drum 1 remains practically the same in the potential level of its electrical charge. Thus, the smaller in absolute value the transfer bias which is opposite in polarity from the electrical charge of the photosensitive drum 1, the smaller the pre-exposure light amount may be, as is evident from Table 1.

Also according to the studies made by the inventors of the present invention, it seems to be reasonable to think that the thinner the photosensitive layer of the photosensitive drum 1, the less likely it is for the post-transfer latent image to occur after the transfer process, for the following reason. That is, the thinner the photosensitive layer of the photosensitive drum 1, the larger is the photosensitive drum 1 in electrostatic capacity, and therefore, it is less likely for the electrical discharge attributable to the transfer bias, which is the primary reason why the post-transfer latent image to occur on the peripheral surface of the photosensitive drum 1 immediately after the completion of the transfer process, to become nonuniform. That is, referring to Table 1, the thinner the photosensitive layer of the photosensitive drum 1 becomes (the greater the cumulative length of time photosensitive drum 1 has been rotated), the smaller the pre-exposure light amount may be made.

Here, as described above, the peripheral surface of the photosensitive drum 1 is shaved by a printing operation, and therefore, as the cumulative length of time the photosensitive drum 1 has been rotated is increased by the repetition of the printing operation, the surface layer of the photosensitive drum 1 is gradually shaved, becoming therefore thinner. Further, generally speaking, as the cumulative length of time the photosensitive drum 1 has been rotated is increased by the repetition of the printing operation, the difference in potential level between the transfer bias and the electrical charge of the photosensitive drum 1 is more likely to be reduced than not. Therefore, in this embodiment, assuming that the ambient temperature and humidity remains stable, the pre-exposing device 10 is controlled so that as the cumulative length of time the photosensitive drum 1 has been rotated is increased by the repetition of printing operation, it reduces the pre-exposure light amount.

Figure 3:
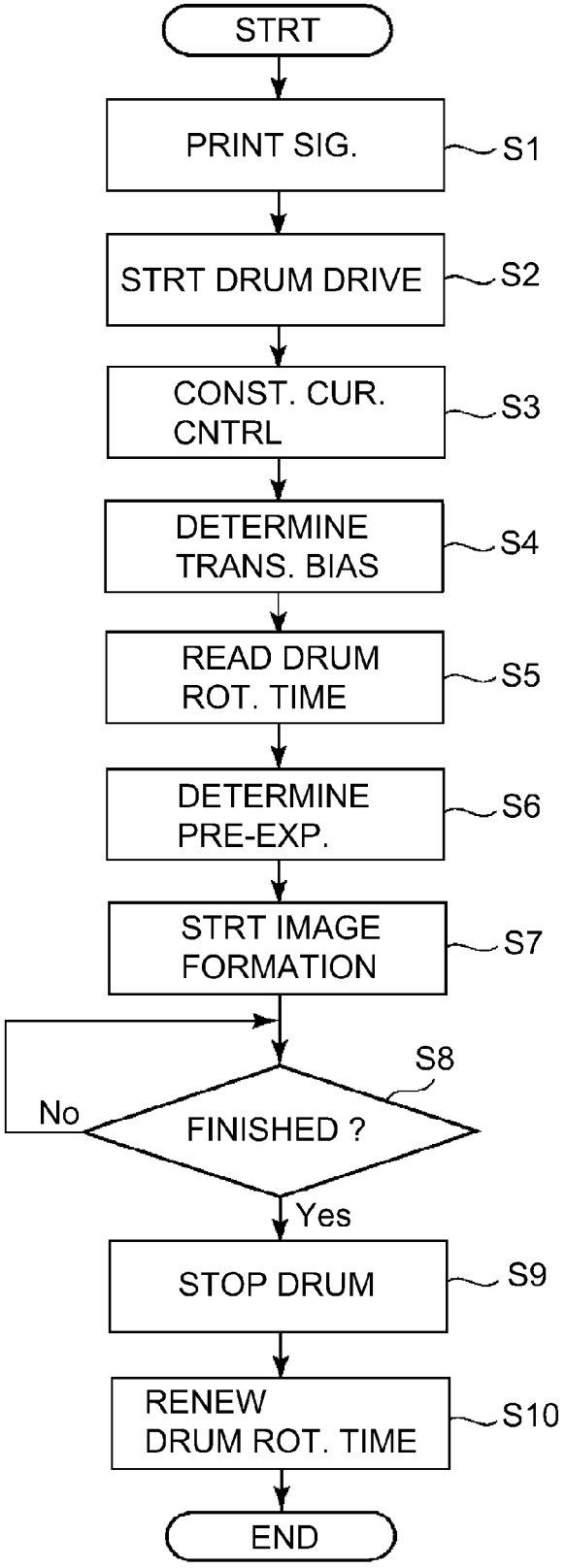
FIG. 3 is a flowchart of the control sequence for the image forming apparatus in the first embodiment.

FIG. 3 is a flowchart of the image forming operation of the image forming apparatus 100 in this embodiment. It includes the step in which the pre-exposing device 10 is controlled in the amount of exposure light. As a print signal (printing operation start command) is inputted (S1), the controller 30 begins to drive the photosensitive drum 1, etc., to start the pre-rotation process (S2). In the pre-rotation process, the controller 30 controls the transfer bias so that the current flowed by the transfer bias remains stable at a preset amount (S3), and decides the voltage value for the transfer bias for the pre-rotation process (S4). Then, the controller 30 reads the cumulative length of time the photosensitive drum 1 has been driven, from the storing portion 12, in the pre-rotation process (S5), and decides the pre-exposure light amount, based on the abovementioned voltage value for the transfer bias, and the cumulative length of time the photosensitive drum 1 has been driven (S6). Then, the controller 30 makes the image forming apparatus 100 start the image formation process after the completion of the preset pre-rotation process (S7). Then, as soon as all the images to be formed in the image formation process are formed (S8), the controller 30 makes the image forming apparatus 100 carry out the preset post-rotation process, and stops driving the photosensitive drum 1, etc. (S9). Further, the controller 30 adds the length of time the photosensitive drum 1 was rotated during the image forming operation (job), which was measured by the thickness detecting portion 34, to the cumulative length of time the photosensitive drum 1 has been rotated, which is stored in the storing portion 12, renewing thereby the cumulative length of time the photosensitive drum 1 has been driven, which is stored in the storing portion 12 (S10).

Figure 4:
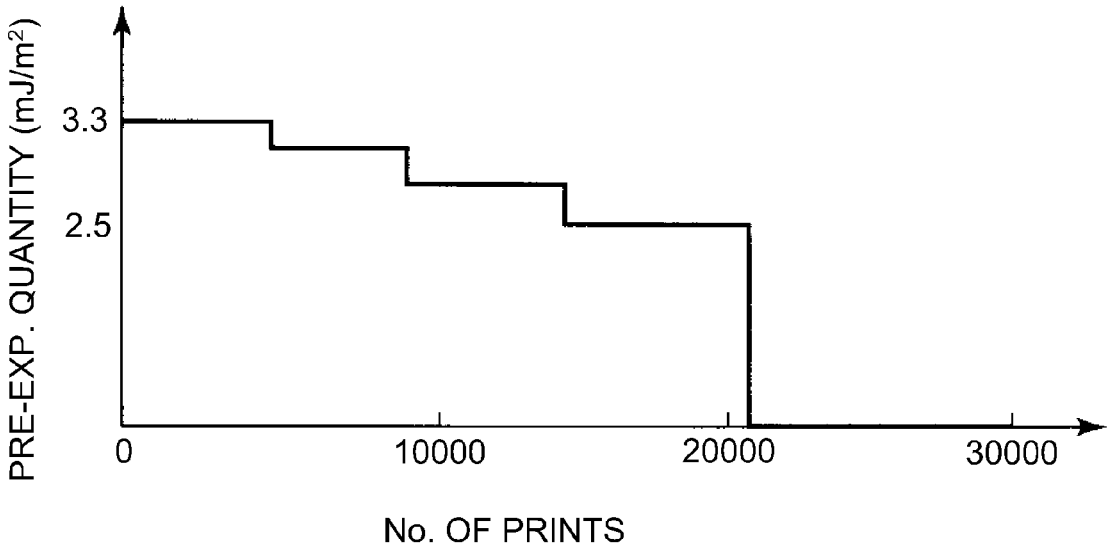
FIG. 4 is a graph which shows the changes which occurred to the amount of pre-exposure light in the first embodiment.

FIG. 4 shows the changes which occurred to the pre-exposure light amount in an endurance test in which 30,000 images were outputted, with the pre-exposure light amount set according to the present invention. The ambient temperature and humidity were controlled so that they remain practically stable throughout the test period. During the test period, a halftone image was printed every 2,000 sheets of recording medium, to confirm whether or not the image defects occurred. As a result, the image defects (nonuniformity in image density) attributable to the post-transfer latent image on the peripheral surface of the photosensitive drum 1, and the image defects (reduction in image density) attributable to the deterioration of the photosensitive drum 1, did not occur throughout the test period. As described above, in this embodiment, the proper amount for the pre-exposure light is obtained based on the voltage value of the transfer bias, and the thickness (cumulative length of time photosensitive drum 1 has been rotated). Therefore, it is possible to accomplish both the objective of preventing the occurrence of the image defects which are attributable to the post-transfer latent image on the peripheral surface of the photosensitive drum 1, and the objective of extending the life of the photosensitive drum 1.

Figure 5:
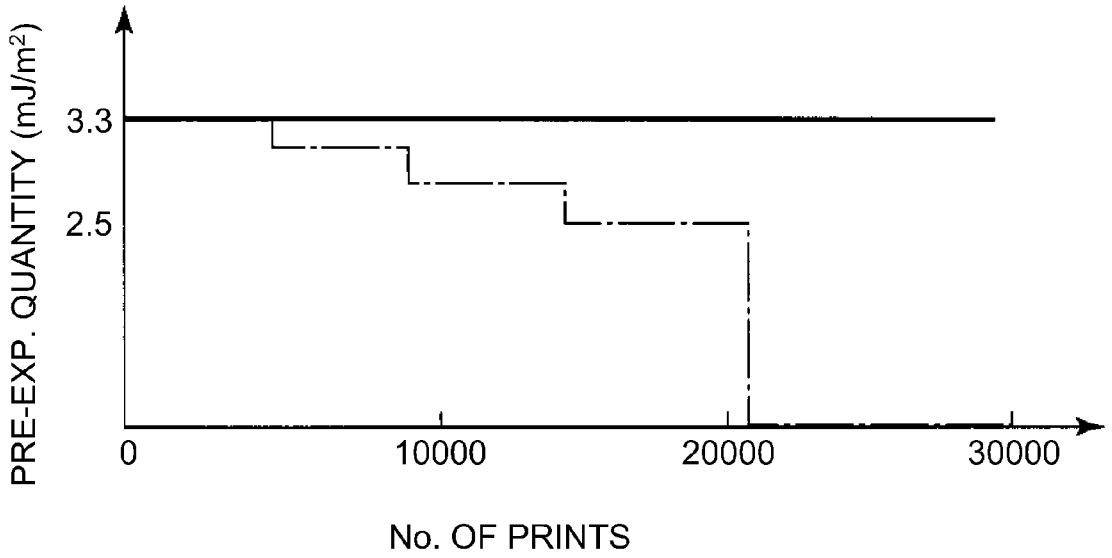
FIG. 5 is a graph which shows the changes which occurred to the amount of pre-exposure light in the first example of comparative image forming apparatus (pre-exposing device).

Next, one (first) of comparative methods for controlling the amount of pre-exposure light is described. Referring to FIG. 5 (in which broken line represents first embodiment), in the case of this comparative method, an endurance test, which is similar to the one carried out to test the method in the first embodiment, was performed. In this case, however, the amount of pre-exposure light was fixed to 3.3 mJ/m$^2$, which is the same as the initial amount in the first embodiment. By the way, the image forming apparatus 100 used to test the first comparative method was the same as the one in the first embodiment, except for the method used to control the pre-exposing device 10 in the amount of pre-exposure light. As a result, the image defects which are attributable to the post-transfer latent image, which is present on the peripheral surface of the photosensitive drum 1 after the transfer process, did not occur. However, after roughly 24,000 images were outputted, the image defects (reduction in image density) attributable to the excessive shaving of the photosensitive drum 1 began to occur. It seems reasonable to think that this phenomenon occurred because the continuous exposure of the peripheral surface of the photosensitive drum 1 to the pre-exposure light by an amount greater than the minimum amount necessary to rid the peripheral surface of the photosensitive drum 1 of the post-transfer latent image increased the rate at which the photosensitive drum 1 was shaved, and therefore, the photosensitive drum 1 was reduced in life expectancy.

Next, an endurance test which is similar to the one conducted to test the first embodiment was conducted to test the second example of comparative method. In this test, the pre-exposing device 10 was controlled so that it did not emit light. By the way, the image forming apparatus 100 used to test the second example of comparative method was the same as the image forming apparatus 100 in the first embodiment, except that the image forming apparatus 100 used to test the second example of comparative method was controlled so that it did not emit light. As a result, the image defects attributable to the post-transfer latent image which was on the peripheral surface of the photosensitive drum 1 after the transfer process, occurred from the very beginning of the test. Thus, the same endurance test was conducted, with the pre-exposure light amount fixed to 1.65 mJ/m$^2$, which is half the initial amount of pre-exposure light used in the first embodiment. Also in this test, the image defects attributable to the post-transfer latent image which was on the peripheral surface of the photosensitive drum 1 after the transfer process, began to occur during the initial stage of the image forming operation, although the image defects were not as conspicuous as those which occurred when the pre-exposing device 10 was prevented from emitting light.

As described above, in this embodiment, the image forming apparatus 100 has: the rotatable photosensitive drum 1 which has a photosensitive layer; and the charging member 2 which is disposed in contact with the photosensitive drum 1, and to which DC voltage is applied to charge the peripheral surface of the photosensitive drum 1. Further, the image forming apparatus 100 has: the developing means 4 which forms a toner image by developing, with the use of developer, an electrostatic image formed on the photosensitive drum 1 after the abovementioned charging of the peripheral surface of the photosensitive drum 1; and the transferring member 5 which transfers the toner image formed on the photosensitive drum 1, onto a sheet P of transfer medium. Further, the image forming apparatus 100 has: the bias applying device 31 which applies the transfer bias to the transferring member 5 to transfer the toner image onto the sheet P; and the illuminating portion 10 which shed light upon the photosensitive drum 1 during the period between the completion of the image transfer and the beginning of the charging of the photosensitive drum 1. Further, the image forming apparatus 100 has: the controller 30 which controls the amount by which light is shed upon the photosensitive drum 1 by the illuminating portion 10, based on the information related to the transfer bias and the information related to the thickness of the photosensitive layer 1*b* of the photosensitive drum 1. If the transfer bias remains the same in potential level, the controller 30 controls the image forming apparatus 100 so that the amount by which the light is shed when the thickness of the photosensitive layer 1*b* has the fourth value becomes smaller than when the thickness of the photosensitive layer 1*b* has the third value. Further, if the photosensitive layer 1*b* remains the same in thickness, the controller 30 controls the image forming apparatus 100 so that the amount by which the light is shed when the thickness of the photosensitive layer 1*b* has the second value which is to be used when the difference in potential level between the transfer bias and the electrical charge of the photosensitive drum 1, becomes smaller than the amount by which light is shed when the transfer bias has the first value.

As described above, according to this embodiment, it is possible to minimize the post-transfer latent image which is present on the peripheral surface of the photosensitive drum 1 after the transfer process, while extending the photosensitive drum 1 in life expectancy.

[Miscellanies]

In the foregoing, the present invention was described with reference to one of embodiments of the present invention. However, the embodiment is not intended to limit the present invention in scope.

The measurements, materials, and shapes of the structural components of the image forming apparatus 100 in the above-described embodiment, and their positional relationship, are not intended to limit the present invention in scope, unless specifically noted.

In the above-described embodiment, the pre-exposure light amount was controlled according to Table 1. However, the value to which the pre-exposure light amount is to be set may be changed according to the structure or the like of the image forming apparatus 100.

Further, in the above-described embodiment, the voltage value of the transfer bias itself was used as the information related to the transfer bias, which is for deciding the pre-exposure light amount. However, information which is equivalent to the voltage value for the transfer bias, which is used to decide the amount of the transfer bias, may be used to decide the pre-exposure light amount. For example, one, or a combination of two or more, of the information regarding the ambient temperature, ambient humidity, process speed, paper type, and the information regarding the first and second surfaces in the two-sided printing mode, etc., may be used in place of the voltage value of the transfer bias itself. By the way, in a case where the bias to be applied in the transfer process is controlled so that the current induced by the transfer voltage remains stable at a preset level, the current value, or the information equivalent to the current value, may be used as the information regarding the transfer bias.

Further, in the above-described embodiment, the cumulative length of time the photosensitive drum 1 has been rotated was used as the information regarding the thickness of the photosensitive layer of the photosensitive drum 1. However, any information can be used as long as it has correlation to the thickness of the photosensitive layer of the photosensitive drum 1. For example, any, or a combination of two or more, of the cumulative length of time the charge bias was applied (length of time voltage was applied to charging member), value of charge current (value of current which flowed when voltage was applied to charging member), cumulative length of time the developing member, which is placeable in contact with the photosensitive drum 1, was kept in contact with the photosensitive drum 1, may be used. That is, the greater the length of time the charge bias is applied; the greater the value of the charge current; or the greater the length of time the developing member is kept in contact with the photosensitive drum 1, the thinner the surface layer of the photosensitive drum 1 is likely to become. Thus, the information can be used as the information for estimating the thickness of the photosensitive layer of the photosensitive drum 1, like the cumulative length of time the photosensitive drum 1 has been rotated.

Further, in the foregoing, the embodiment was described based on the assumption that the photosensitive drum 1 remains stable in the potential level of its electrical charge. However, the present invention is applicable even if the photosensitive drum 1 is variable in the potential level of its electrical charge. Even if the photosensitive drum 1 is variable in the potential level of its electrical charge, all that is necessary is that the pre-exposing device is controlled so that the smaller the difference in potential level between the transfer bias and the electrical charge of the photosensitive drum 1, the smaller the pre-exposure light amount becomes.

Further, in the foregoing, the embodiment was described assuming that the photosensitive drum 1 remained stable in peripheral velocity in practical term. However, the photosensitive drum 1 may be variable in peripheral velocity. Even if the photosensitive drum 1 is variable in peripheral velocity, all that is necessary is that the pre-exposure light amount is adjusted according to the peripheral velocity of the photosensitive drum 1 so that the relationship among the transfer bias, thickness of the photosensitive layer, and amount of the pre-exposure light amount becomes the same as the one in the first embodiment. That is, for example, two or more information regarding the relationship among the transfer bias, thickness of the photosensitive layer, and pre-exposure light amount may be selectively used according to the peripheral velocity of the photosensitive drum 1. In a case where the peripheral velocity of the photosensitive drum 1 is relatively fast, the pre-exposure light amount is to be made relatively large, whereas in a case where the peripheral velocity of the photosensitive drum 1 is relative slow, the pre-exposure light amount is to be made relatively small. That is, all that is necessary is that the pre-exposure light amount of the pre-exposing device 10 is defined as the amount by which light is shed onto the peripheral surface of the photosensitive drum 1, and this pre-exposure light amount is controlled based on the information related to the transfer bias, and the information related to the thickness of the photosensitive layer of the photosensitive drum 1.

Further, in the above-described embodiment, the photosensitive member was the photosensitive drum 1 which is rotatable. However, it may be in the other forms than a rotatable photosensitive drum. For example, it may be a circularly movable endless belt.

Further, in the above-described embodiment, the image forming apparatus 100 was structured so that a toner image is directly transferred from its photosensitive member onto transfer medium such as a sheet of paper. However, the present invention is also applicable to any image forming apparatus of the so-called intermediary transfer type, which has been well-known among the people in this field.

Further, in the above-described embodiment, the charging member was in contact with the photosensitive member. However, the present invention does not require that a charging member such as a charge roller is in contact with the peripheral surface of a photosensitive member as a member to be charged. That is, the present invention is applicable to any image forming apparatus as long as the charging member and photosensitive member of the image forming apparatus are disposed close enough to each other for electric discharge to occur between the charging member and the peripheral surface of the photosensitive member, in the area in which the distance between the two members is smallest. For example, all that is necessary for the present invention to be applicable to a given image forming apparatus is that the abovementioned two members of the apparatus are disposed so that there is several tens of micrometers of air gap (gap) between the two.

Further, in the above-described embodiment, the sequence for controlling the transfer bias and the sequence for controlling the pre-exposure light amount was carried out for every job, in the pre-rotation process. However, this embodiment is not intended to limit the present invention in scope. That is, the period in which the transfer bias is changed in value through the transfer bias control sequence or the like does not need to be limited to the period which corresponds to the pre-rotation process. That is, it may be any idling period (period in which an image is not formed). For example, it may be any sheet interval in an image forming operation in which multiple images are continuously formed on multiple sheets of transfer medium, one for one, any interval between the formation of an image on the first surface of a sheet of transfer medium and the formation of an image on the second surface the sheet, when an image forming apparatus is in the two-sided mode. By the way, it is desired that the pre-exposure light amount control sequence is carried out each time the transfer bias is changed. However, it is not mandatory. For example, an image forming apparatus may be set up so that the pre-exposure light amount control sequence is carried out once for each job, or every two or more changes in the value of the transfer bias.

Further, it is not mandatory that the pre-exposure light amount is decided with the use of the value set for the transfer bias through the transfer bias control sequence, as in the above-described embodiment. However, it is desired that the transfer bias is controlled based on the information related to the electrical resistance of the transferring portion. For example, the value for the transfer bias may be set according to any, or a combination of two or more, of the above-described information regarding the temperature, humidity, process speed, paper type, whether an image is to be formed on the first or second surface of a sheet of transfer medium in the two-sided printing mode, etc.

Further, the photosensitive layer of a photosensitive member means one, or a combination of two or more, of the layers formed on the electrically conductive substrate of the photosensitive member. That is, two or more functional layers such as a charge generation layer, charge transfer layer, and a surface protection layer, may be formed as parts of the photosensitive layer on the substrate, as it has been known among the people in this field. Generally speaking, also in such a case, the photosensitive layer gradually reduces in overall thickness, as the photosensitive member increases in the cumulative length of time it has been rotated. Therefore, it is possible to set a proper amount for the pre-exposure light according to the thickness of the photosensitive layer, by obtaining in advance the relationship between the information related to the thickness of the photosensitive layer (cumulative length of time photosensitive member has been rotated), and the proper amount for the pre-exposure light, as described above.

Further, in the above-described embodiment, the information related to the thickness of the photosensitive layer of the photosensitive member was stored in the storing means, with which the cartridge, which is removably installable in the main assembly of the image forming apparatus and is equipped with the photosensitive member, is provided. However, this embodiment is not intended to limit the present invention in scope. According to this type of structural arrangement for an image forming apparatus, even in a case where two or more cartridges which are in the main assembly of the image forming apparatus and are still usable, are replaced, a proper control sequence can be easily carried out according to the thickness of the photosensitive layer of the photosensitive member. However, the information related to the thickness of the photosensitive member may be stored in the storing means with which the main assembly of the image forming apparatus is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-204119 filed on Oct. 15, 2015, which is hereby incorporated by reference herein in its entirety.

What is claimed is:

1. An image forming apparatus comprising:

a rotatable photosensitive member including a photosensitive layer;

a charging member provided in contact with or in proximity with said photosensitive member and configured to be supplied with a DC voltage to charge a surface of said photosensitive member;

developing means configured to develop an electrostatic image formed on said photosensitive member into a toner image, after charging of said photosensitive member by said charging means;

a transfer member configured to transfer the toner image from said photosensitive member onto a toner image receiving member;

an application device configured to apply to said transfer member a transfer voltage for transferring the image from said photosensitive member onto the toner image receiving member;

a light projecting portion configured to project light to said photosensitive member before the charging by said charging means and after the image transfer by said transfer means; and a controller configured to control a light quantity of the light projected to said photosensitive member by said light projecting portion, on the basis of information relating to the transfer voltage and information relating to a film thickness of said photosensitive layer, wherein under a condition that the film thickness is the same, the light quantity controlled by said controller is smaller when the transfer voltage is a second value than when it is a first value, wherein a difference of the second value from a charged potential of said photosensitive member is smaller than that of the first value.

2. An apparatus according to claim 1, wherein under a condition that the transfer voltage is the same, the light amount controlled by said controller is smaller when the film thickness is a fourth value than when it is a third value, the fourth value being smaller than the third value.

3. An apparatus according to claim 1, wherein the information relating to the transfer voltage is a value of the transfer voltage or a value to be used for determining the transfer voltage.

4. An apparatus according to claim 1, wherein the information relating to the film thickness is one or a combination of two or more of a cumulative rotation time of said photosensitive member, a cumulative rotation number of said photosensitive member, a cumulative time of voltage application to said charging member, a current flowing through said charging member when a voltage is applied to said charging member, and cumulative contact time of a developing member of said developing means to said photosensitive member.

5. An apparatus according to claim 1, wherein said photosensitive member is provided in a cartridge mountable to a main assembly of said apparatus, and said cartridge is provided with storing means for storing the information relating to the film thickness.

6. An apparatus according to claim 1, wherein said transfer member is pressed toward and contact with said photosensitive member, a nip as a transferring portion is formed by said transfer member and said photosensitive member.

7. An apparatus according to claim 1, wherein said transfer member is a sponge roller including an electrically conductive metallic core and a foamed electrically conductive elastic layer.

8. An apparatus according to claim 1, wherein said controller is further configured to obtain information relating to the transfer voltage and to obtain information relating to the film thickness of said photosensitive layer, wherein said controller controls the light quantity of the light projected to said photosensitive member by said light projecting portion on the basis of the obtained information relating to the transfer voltage and the obtained information relating to a film thickness of said photosensitive layer.

* * * * *